US011686067B2

(12) United States Patent
Veasy et al.

(10) Patent No.: US 11,686,067 B2
(45) Date of Patent: Jun. 27, 2023

(54) MOTOR GRADER CUTTING EDGE WEAR CALIBRATION AND WARNING SYSTEM

(71) Applicant: Deere & Company, Moline, IL (US)

(72) Inventors: David A. Veasy, Dubuque, IA (US); Craig Christofferson, Dubuque, IA (US); Michael D. Peat, Dubuque, IA (US); Nathan J. Horstman, Dubuque, IA (US); Joshua M. Schau, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 314 days.

(21) Appl. No.: 16/413,210

(22) Filed: May 15, 2019

(65) Prior Publication Data

US 2020/0362535 A1 Nov. 19, 2020

(51) Int. Cl.
*E02F 9/28* (2006.01)
*E02F 9/24* (2006.01)
(Continued)

(52) U.S. Cl.
CPC ..... *E02F 9/2025* (2013.01); *E02F 3/815* (2013.01); *E02F 9/264* (2013.01)

(58) Field of Classification Search
CPC ..... E02F 9/2025; E02F 3/815; E02F 9/264; E02F 3/765; E02F 3/7645; E02F 9/267;
(Continued)

(56) References Cited

U.S. PATENT DOCUMENTS 4,571,994 A * 2/1986 Dickey ..... G01M 99/00 73/40.5 A
4,938,054 A * 7/1990 Dye ..... G01S 7/52004 73/239
(Continued)

FOREIGN PATENT DOCUMENTS

DE 112015003571 T5 4/2017
EP 3105544 B1 8/2019
WO WO2018009955 A1 1/2018

OTHER PUBLICATIONS

German Search Report issued in counterpart application No. 102020205211.5 dated Feb. 25, 2021 (10 pages).

*Primary Examiner* — Edwin J Toledo-Duran
(74) *Attorney, Agent, or Firm* — Taft Stettinius & Hollister LLP; Stephen F. Rost

(57) ABSTRACT

A system, method, and apparatus includes measuring wear of a cutting edge of a blade of a work vehicle. Blade position or calibration measurements are made with or without a cutting edge. A wear condition of the cutting edge is acceptable when the blade position measurement less an acceptable wear to the cutting edge amount is less than a blade calibration measurement. A wear condition of the cutting edge is unacceptable when the blade position measurement less an acceptable wear to the cutting edge amount is greater than a blade calibration measurement. Alternatively, a wear condition of the cutting edge is unacceptable when a blade calibration measurement plus a tolerance margin is greater than the blade position measurement. The wear condition of the cutting edge is acceptable when the blade calibration measurement plus a tolerance margin is less than the blade position measurement.

19 Claims, 5 Drawing Sheets

(51) Int. Cl.

| | |
|---|---|
| ***E02F 9/20*** | (2006.01) |
| ***E02F 3/815*** | (2006.01) |
| ***E02F 9/26*** | (2006.01) |

(58) Field of Classification Search

CPC . E02F 3/845; E02F 3/8152; E02F 9/24; E02F 3/431; E02F 3/435; E02F 3/847; E02F 9/2883; E02F 3/7636; E02F 9/285; E02F 9/2858; E02F 9/2833; E02F 3/764; E02F 3/7604; E02F 3/844; E02F 9/28; E02F 9/2808; E02F 9/2825; E02F 3/80; E02F 3/968; E02F 9/2891; E02F 3/7654; E02F 3/7668; E02F 3/8157; E02F 3/38; E02F 3/627; E02F 3/657; E02F 3/7622; E02F 3/7631; E02F 3/7695; E02F 3/8155; E02F 7/00; E02F 9/12; E02F 9/207; E02F 9/2816; E02F 9/205; E02F 9/262; E02F 9/2054; E02F 9/265; E02F 9/268; E02F 9/2045; E02F 9/226; E02F 3/32; E02F 3/3411; E02F 3/96; E02F 9/006; E02F 9/0841; E02F 9/2033; E02F 3/43; E02F 3/842; E02F 3/964; E02F 5/00; E02F 5/08; E02F 5/10; E02F 5/101; E02F 5/106; E02F 5/12; E02F 5/18; E02F 5/32; E02F 9/085; E02F 9/2029; E02F 9/2203; E02F 9/2285; E02F 9/245; E02F 9/26; G07C 5/006; G07C 5/0808; F15B 19/005; F15B 2211/6336

USPC ..... 701/50, 469; 172/1

See application file for complete search history.

(56) References Cited

U.S. PATENT DOCUMENTS

| | | | | |
|---|---|---|---|---|
| 6,253,136 | B1 * | 6/2001 | Stratton | E02F 9/22 172/3 |
| 6,470,606 | B1 * | 10/2002 | Nagahiro | E02F 9/26 37/348 |
| 7,120,523 | B2 * | 10/2006 | Muller | G07C 3/00 701/33.9 |
| 9,243,381 | B2 * | 1/2016 | Behmlander | E02F 3/8152 |
| 9,279,235 | B1 | 3/2016 | Becicka et al. | |
| 9,592,866 | B2 * | 3/2017 | Hasselbusch | B62D 55/20 |
| 2008/0153402 | A1 * | 6/2008 | Arcona | B24B 49/04 451/352 |
| 2011/0213529 | A1 * | 9/2011 | Krause | E02F 3/431 701/50 |
| 2015/0008296 | A1 * | 1/2015 | Longaphie | E02F 3/7636 414/800 |
| 2015/0135866 | A1 * | 5/2015 | Staade | E02F 3/764 74/89.18 |
| 2015/0322634 | A1 * | 11/2015 | Stock | E01C 23/127 73/431 |
| 2016/0076226 | A1 * | 3/2016 | Edara | G07C 5/0841 701/25 |
| 2016/0208460 | A1 * | 7/2016 | Kirsch | E02F 3/764 |
| 2016/0237640 | A1 * | 8/2016 | Carpenter | E02F 9/2833 |
| 2016/0326723 | A1 * | 11/2016 | Behmlander | G01N 29/043 |
| 2016/0376771 | A1 * | 12/2016 | Behmlander | E02F 9/26 37/453 |
| 2017/0103506 | A1 * | 4/2017 | Dandibhotla | G06T 7/0008 |
| 2017/0241107 | A1 | 8/2017 | Bewley et al. | |
| 2017/0275854 | A1 * | 9/2017 | Izumikawa | E02F 9/2808 |
| 2018/0061040 | A1 | 3/2018 | Beery et al. | |
| 2018/0298593 | A1 | 10/2018 | Dusha | |
| 2020/0362542 | A1 * | 11/2020 | Veasy | E02F 3/764 |

* cited by examiner

MOTOR GRADER CUTTING EDGE WEAR CALIBRATION AND WARNING SYSTEM

FIELD OF THE DISCLOSURE

The present disclosure relates to a work vehicle having an adjustable work implement, and in particular to a motor grader having a blade wherein the wear of the cutting edge of the blade is determined using sensors installed on the work vehicle.

BACKGROUND OF THE DISCLOSURE

A work vehicle, such as a motor grader, can be used in construction and maintenance for creating a flat surface at various angles, slopes, and elevations. When paving a road for instance, a motor grader can be used to prepare a base foundation to create a wide flat surface to support a layer of asphalt. A motor grader can include two or more axles, with an engine and cab disposed above the axles at the rear end of the vehicle and another axle disposed at the front end of the vehicle.

Motor graders include a drawbar assembly attached near the nose of the grader which is pulled by the grader as it moves forward. The drawbar assembly supports a circle drive member at a free end of the drawbar assembly and the circle drive member supports a work implement, such as the blade. The blade, also called a moldboard, is attached to the vehicle between the front axle and rear axle. The angle of the work implement beneath the drawbar assembly can be adjusted by the rotation of the circle drive member relative to the drawbar assembly.

The blade is also adjustable to a selected angle with respect to gravity. This angle is known as blade slope. The elevation of the blade is also adjustable.

To properly grade a surface, the motor grader includes a plurality of sensors. One sensor system measures the orientation of the vehicle with respect to gravity. Another sensor system measures the location of the blade with respect to the vehicle or with respect to gravity.

All motor graders use a blade having a cutting edge attached to the bottom of the moldboard to interact with the grading surface. Due to varying surface types, blade or cutting edge material and design, the amount of wear endured varies over time. These cutting edges on the blade are designed to wear and provide the appropriate interaction to the grading surface without damaging the moldboard. Occasionally an operator will wear the cutting edge to the point that the moldboard itself interacts with the grading surface which can damage the moldboard.

Once the moldboard starts to wear, cutting edges are difficult to install and could require the moldboard to be replaced which is costly. The operator typically determines by sight or measurement how much the cutting edge on the moldboard has worn. In addition, grade control systems require this wear measurement in order to maintain accuracy.

Machine control systems, which include two dimensional (2D) and three dimensional (3D) machine control systems, can be located at or near the surface being graded to provide grade information to the motor grader. A vehicle grade control system receives signals from the machine control system to enable the motor grader to grade the surface. The motor grader may include a grade control system operatively coupled to each of the sensors, so that the surface being graded can be graded to the desired slope, angle, and elevation. The desired grade of the surface is planned ahead of or during a grading operation.

Machine control systems can provide slope and elevation signals to the vehicle grade control system to enable the motor grader or an operator to adjust the slope and elevation of the blade. The vehicle grade control system can be configured to automatically control the slope and elevation of the blade to grade the surface based on desired slopes and elevations as is known by those skilled in the art. In these automatic systems, adjustments to the position of the blade with respect to the vehicle are made constantly in order to achieve the slope and/or elevation targets.

What is needed, therefore, is a control system to accurately determine the wear of the cutting edge of the implement over time.

SUMMARY

According to one embodiment of the present disclosure, a method for measuring wear of a cutting edge of a blade of a work vehicle, the method comprising: measuring a calibration measurement position of the blade with the cutting edge attached thereto, while the blade is in a measurement position with a blade position sensor system of the work vehicle; measuring a blade position measurement of the blade in the measurement position with the blade position sensor system of the work vehicle at a later point in time; and upon comparison of the blade measurement position to the calibration measurement position, determining a wear condition of the cutting edge of the blade as either acceptable wherein the cutting edge does not require replacement or unacceptable wherein the cutting edge does require replacement.

In one example, the determining the unacceptable wear condition of the cutting edge of the blade includes the blade position measurement less an acceptable wear amount to the cutting edge being greater than the blade calibration measurement.

In a second example, the determining the wear condition of the cutting edge includes calculating an amount the cutting edge has worn.

In a third example, the determining the acceptable wear condition of the cutting edge of the blade when the blade position measurement less an acceptable wear to the cutting edge amount is less than the blade calibration measurement.

In a fourth example, the determining the wear condition includes calculating an amount that the cutting edge has worn.

In a fifth example, further comprising: sending a warning signal to the work vehicle when the unacceptable wear condition is satisfied. In a further refinement, the warning signal is a message displayed on a display mechanism of the work vehicle.

In a sixth example, further comprising: limiting productive movement of the blade when the unacceptable wear condition is satisfied. In a further refinement, the productive movement of the blade is not enabled when the unacceptable wear condition is satisfied.

In a seventh example, the blade measurement position includes resting the blade on a ground plane.

In an eighth example, further comprising: communicating the blade wear measurement to a grade control system to adjust one or more of a slope, an angle, or an elevation of the blade.

In a ninth example, the wear condition of the cutting edge of the blade includes a wear value of the blade.

In a tenth example, further comprising: moving the blade, with a cutting edge attached, to the measurement position.

In a second embodiment, a method for measuring wear of a cutting edge of a blade of a work vehicle, the method comprising: measuring a calibration measurement position of the blade, without the cutting edge attached thereto, while the blade is in a measurement position with a blade position sensor system of the work vehicle; measuring a blade position measurement of the blade, with the cutting edge attached thereto, while the blade is in the measurement position with the blade position sensor system of the work vehicle at a later point in time; and upon comparison of the blade measurement position to the calibration measurement position, determining a wear condition of the cutting edge of the blade as either acceptable wherein the cutting edge does not require replacement or unacceptable wherein the cutting edge does require replacement.

In one example, the determining the unacceptable wear condition of the cutting edge of the blade includes the blade calibration measurement plus a tolerance margin being greater than the blade position measurement.

In a second example, the determining the acceptable wear condition of the cutting edge of the blade includes the blade calibration measurement plus a tolerance margin being less than the blade position measurement.

In a third example, further comprising: sending a warning signal to the work vehicle when the unacceptable wear condition is satisfied.

In a fourth example, further comprising: limiting productive movement of the blade when the unacceptable wear condition is satisfied.

In a fifth example, the productive movement of the blade is not enabled when the unacceptable wear condition is satisfied.

In a sixth example, the blade measurement position includes resting the blade on a ground plane.

In a seventh example, determining a wear value from the wear condition; and communicating the wear value to a grade control system to adjust one or more of a slope, an angle, or an elevation of the blade.

In a third embodiment, a method for measuring wear of a cutting edge of a blade of a work vehicle, the method comprising: measuring a calibration measurement position of the blade with the cutting edge attached thereto, by measuring a right cylinder position of a right hydraulic cylinder of the work vehicle and measuring a left cylinder position of a left hydraulic cylinder of the work vehicle; measuring a blade position measurement of the blade in the measurement position at a later point in time by measuring the right cylinder position of a right hydraulic cylinder of the work vehicle and measuring the left cylinder position of a left hydraulic cylinder of the work vehicle at a later point in time; and upon comparison of the blade measurement position to the calibration measurement position, determining a wear condition of the cutting edge of the blade as either acceptable wherein the cutting edge does not require replacement or unacceptable wherein the cutting edge does require replacement.

In one example of the third embodiment, wherein the calibration blade measurement position and the blade measurement position include moving one or more of a circle side shift cylinder, a circle drive assembly, and a blade pitch actuator of the work vehicle into their respective defined positions.

In a second example of the third embodiment, the calibration blade measurement position and the blade measurement position include measuring one or more positions of the circle side shift cylinder, the circle drive assembly, and the blade pitch actuator of the work vehicle in their respective defined positions.

In a third example of the third embodiment, the calibration blade measurement position and the blade measurement position are made by measuring a position of a circle side shift cylinder of the work vehicle.

In a fourth example of the third embodiment, the calibration blade measurement position and blade measurement position include moving one or more of the left hydraulic actuator, right hydraulic actuator, circle drive assembly, and blade pitch hydraulic actuator into a defined measurement position.

In a fifth example of the third embodiment, the calibration blade measurement and the blade position measurement include measuring one or more of the position of a left hydraulic actuator, the position of a right hydraulic actuator, the position of a blade pitch hydraulic actuator, and the position of a circle drive assembly.

In a sixth example of the third embodiment, the calibration blade measurement and blade position measurement are made by a camera mounted to the work vehicle in a fixed position.

In a seventh example of the third embodiment, the calibration blade measurement and the blade position measurement are made by a grade control system.

In an eighth example of the third embodiment, a known point reference is used in coordination with the grade control system to perform the calibration blade measurement and the blade position measurement.

In a fourth embodiment, a method for measuring wear of a cutting edge of a blade of a work vehicle, the method comprising: measuring a calibration measurement position of the blade, without the cutting edge attached thereto, by measuring a right cylinder position of a right hydraulic cylinder of the work vehicle and measuring a left cylinder position of a left hydraulic cylinder of the work vehicle; measuring a blade position measurement of the blade in the measurement position at a later point in time by measuring the right cylinder position of a right hydraulic cylinder of the work vehicle and measuring the left cylinder position of a left hydraulic cylinder of the work vehicle at a later point in time; and upon comparison of the blade measurement position to the calibration measurement position, determining a wear condition of the cutting edge of the blade as either acceptable wherein the cutting edge does not require replacement or unacceptable wherein the cutting edge does require replacement.

In a first example of the fourth embodiment, the calibration blade measurement position and blade measurement position include moving one or more of the circle side shift hydraulic actuator, circle drive assembly, and blade pitch hydraulic actuator into a defined measurement position.

In a second example of the fourth embodiment, the calibration blade measurement and the blade position measurement include measuring one or more of the position of a circle side shift hydraulic actuator, the position of a blade pitch hydraulic actuator, and the position of a circle drive assembly.

In a third example of the fourth embodiment, the calibration blade measurement and the blade position measurement are made by measuring a position of a circle side shift cylinder of the work vehicle.

In a fourth example of the fourth embodiment, the calibration blade measurement position and blade measurement position include moving one or more of the left hydraulic actuator, right hydraulic actuator, circle drive assembly, and blade pitch hydraulic actuator into a defined measurement position.

In a fifth example of the fourth embodiment, the calibration blade measurement and the blade position measurement include measuring one or more of the position of a left hydraulic actuator, the position of a right hydraulic actuator, the position of a blade pitch hydraulic actuator, and the position of a circle drive assembly.

In a sixth example of the fourth embodiment, the calibration blade measurement and blade position measurement are made by a camera mounted to the work vehicle in a fixed position.

In a seventh example of the fourth embodiment, the calibration blade measurement and the blade position measurement are made by a grade control system.

In an eighth example of the fourth embodiment, a known point reference is used in coordination with the grade control system to perform the calibration blade measurement and the blade position measurement.

In an embodiment of the present disclosure, a method for measuring wear of a cutting edge of a blade of a work vehicle includes measuring a calibration position measurement of the blade with the cutting edge attached thereto, while the blade is in a measurement position with a blade position sensor system of the work vehicle; measuring a blade position measurement of the blade in the measurement position with the blade position sensor system of the work vehicle at a later point in time; and upon comparison of the blade position measurement to the calibration position measurement, determining a wear condition of the cutting edge of the blade as either acceptable wherein the cutting edge does not require replacement or unacceptable wherein the cutting edge does require replacement.

In one example of this embodiment, the determining the wear condition of the cutting edge includes calculating an amount the cutting edge has worn. In a second example, the determining the acceptable wear condition of the cutting edge of the blade when the blade position measurement less an acceptable wear to the cutting edge amount is less than the blade calibration position measurement. In a third example, the method includes sending a warning signal to the work vehicle when the unacceptable wear condition is satisfied. In a fourth example, the warning signal is a message displayed on a display mechanism of the work vehicle.

In a fifth example of this embodiment, the method includes limiting productive movement of the blade when the unacceptable wear condition is satisfied. In a sixth example, the productive movement of the blade is not enabled when the unacceptable wear condition is satisfied. In a seventh example, the blade position measurement includes resting the blade on a ground plane. In an eighth example, the method includes communicating the blade wear measurement to a grade control system to adjust one or more of a slope, an angle, or an elevation of the blade. In a ninth example, the method includes moving the blade, with the cutting edge attached, to the measurement position.

In another embodiment of the present disclosure, a method for measuring wear of a cutting edge of a blade of a work vehicle includes measuring a calibration position measurement of the blade, without the cutting edge attached thereto, while the blade is in a measurement position with a blade position sensor system of the work vehicle; measuring a blade position measurement of the blade, with the cutting edge attached thereto, while the blade is in the measurement position with the blade position sensor system of the work vehicle at a later point in time; and upon comparison of the blade position measurement to the calibration position measurement, determining a wear condition of the cutting edge of the blade as either acceptable wherein the cutting edge does not require replacement or unacceptable wherein the cutting edge does require replacement.

In one example of this embodiment, the determining the unacceptable wear condition of the cutting edge of the blade includes the blade calibration position measurement plus a tolerance margin being greater than the blade position measurement. In a second example, the determining the acceptable wear condition of the cutting edge of the blade includes the blade calibration position measurement plus a tolerance margin being less than the blade position measurement. In a third example, the method includes sending a warning signal to the work vehicle when the unacceptable wear condition is satisfied; and displaying the warning signal on a display mechanism of the work vehicle.

In a fourth example, the method includes limiting productive movement of the blade when the unacceptable wear condition is satisfied. In a fifth example, the productive movement of the blade is not enabled when the unacceptable wear condition is satisfied. In a sixth example, the blade position measurement includes resting the blade on a ground plane. In a seventh example, the method includes determining a wear value from the wear condition; and communicating the wear value to a grade control system to adjust one or more of a slope, an angle, or an elevation of the blade. In an eighth example, the determining the wear condition of the cutting edge includes calculating an amount the cutting edge has worn. In a ninth example, the determining the unacceptable wear condition of the cutting edge of the blade includes the blade position measurement less an acceptable wear amount to the cutting edge being greater than the calibration position measurement.

In a further embodiment of the present disclosure, a method for measuring wear of a cutting edge of a blade of a work vehicle includes providing the work machine with a right hydraulic cylinder and a left hydraulic cylinder; measuring a calibration position measurement of the blade with the cutting edge attached thereto by measuring a position of the right cylinder and a position of the left hydraulic cylinder; measuring a blade position measurement of the blade in a measurement position at a later point in time by measuring the position of the right cylinder and the position of the left cylinder; comparing the blade position measurement to the calibration position measurement; and determining a wear condition of the cutting edge of the blade as either acceptable wherein the cutting edge does not require replacement or unacceptable wherein the cutting edge does require replacement.

In one example of this embodiment, the method includes providing the work vehicle with a circle side shift cylinder, a circle drive assembly, and a blade pitch actuator, each of which comprises a respective defined position; and moving at least one of the circle side shift cylinder, a circle drive assembly, and a blade pitch actuator to measure the calibration position measurement and blade position measurement. In a second example, the method includes measuring one or more positions of the circle side shift cylinder, the circle drive assembly, and the blade pitch actuator in their respective defined positions.

In yet another embodiment of the present disclosure, a method for measuring wear of a cutting edge of a blade coupled to a work vehicle includes measuring a calibration position measurement of the blade with the cutting edge attached thereto; measuring a blade position measurement of the blade in a measurement position at a later point in time after the calibration position measurement is made; comparing the blade position measurement to the calibration position measurement; and determining a wear condition of the cutting edge of the blade as either acceptable wherein the cutting edge does not require replacement or unacceptable wherein the cutting edge does require replacement.

In one example of this embodiment, the method includes providing a camera mounted to the work vehicle in a fixed position, the camera detecting the calibration position measurement and the blade position measurement. In a second example, the calibration position measurement and the blade position measurement are made by a grade control system. In a third example, the method includes providing a known point of reference; and using the known point of reference in coordination with the grade control system to measure the calibration position measurement and the blade position measurement.

In yet a further embodiment of the present disclosure, a method for measuring wear of a cutting edge of a blade of a work vehicle includes measuring a calibration position measurement of the blade while the blade is in a measurement position with a blade position sensor system of the work vehicle; measuring a blade position measurement of the blade in the measurement position with the blade position sensor system of the work vehicle at a later point in time; and upon comparison of the blade position measurement to the calibration position measurement, determining a wear condition of the cutting edge of the blade as either acceptable wherein the cutting edge does not require replacement or unacceptable wherein the cutting edge does require replacement.

In one example of this embodiment, the method includes providing the work machine with a right hydraulic cylinder and a left hydraulic cylinder; measuring a position of the right hydraulic cylinder and a position of the left hydraulic cylinder; and determining the calibration position measurement and the blade position measurement from the positions of the right and left hydraulic cylinders. In a second example, the method includes providing the work vehicle with a left saddle arm, a right saddle arm, a saddle pin, a circle side shift hydraulic actuator, a circle drive assembly, and a blade pitch hydraulic actuator; moving one or more of the left saddle arm, right saddle arm, saddle pin, circle side shift hydraulic actuator, circle drive assembly, and blade pitch hydraulic actuator into a measurement position; and determining the calibration position measurement and the blade position measurement from the moving step.

In a third example of this embodiment, the method includes providing the work vehicle with a left saddle arm, a right saddle arm, a saddle pin, a circle side shift hydraulic actuator, a circle drive assembly, and a blade pitch hydraulic actuator; measuring a position of one or more of the left saddle arm, right saddle arm, saddle pin, circle side shift hydraulic actuator, circle drive assembly, and blade pitch hydraulic actuator into a measurement position; and determining the calibration position measurement and the blade position measurement from the measuring a position step. In a fourth example, the method includes providing the work machine with a circle side shift cylinder; measuring a position of the circle side shift cylinder; and determining the calibration position measurement and the blade position measurement based on the position of the circle side shift cylinder.

In another example, the method includes providing the work machine with a left saddle arm, a right saddle arm, a saddle pin, a left hydraulic actuator, a right hydraulic actuator, a circle drive assembly, and a blade pitch hydraulic actuator; moving one or more of the left saddle arm, right saddle arm, saddle pin, left hydraulic actuator, right hydraulic actuator, circle drive assembly, and blade pitch hydraulic actuator into a defined measurement position; and determining the calibration position measurement and the blade position measurement from the moving step. In yet another example, the method includes providing the work machine with a left saddle arm, a right saddle arm, a saddle pin, a left hydraulic actuator, a right hydraulic actuator, a circle drive assembly, and a blade pitch hydraulic actuator; measuring a position of one or more of the left saddle arm rotation, the right saddle arm rotation, the saddle pin position, the left hydraulic actuator, the right hydraulic actuator, the blade pitch hydraulic actuator, and the circle drive assembly; and determining the calibration position measurement and the blade position measurement from the measuring a position step.

In a further example, the method includes providing a camera mounted to the work vehicle in a fixed position, the camera measuring the calibration position measurement and the blade position measurement. In yet a further example, the calibration position measurement and the blade position measurement are made by a grade control system. In yet a further example, the method includes providing a known point of reference; and using the known point of reference in coordination with the grade control system to measure the calibration position measurement and the blade position measurement.

BRIEF DESCRIPTION OF THE DRAWINGS

In order that the advantages of the subject matter may be more readily understood, a more particular description of the subject matter briefly described above will be rendered by reference to certain embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

Corresponding reference numerals are used to indicate corresponding parts throughout the several views.

DETAILED DESCRIPTION

Figure 1:
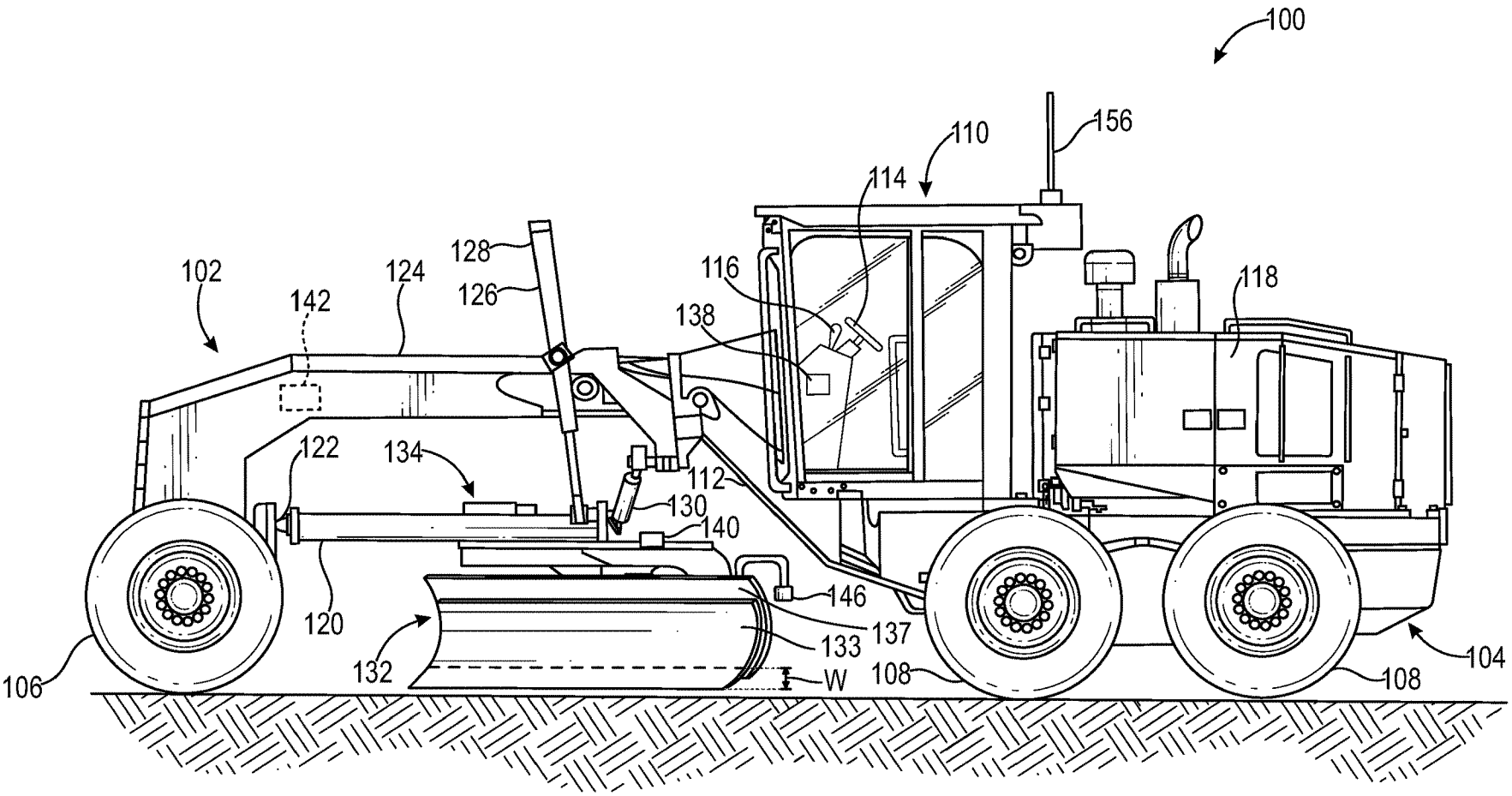
FIG. 1 is a side view of a motor grader.

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

With grade control, an accurate measurement of where the ground plane is relative to a cutting edge mounted on a moldboard to form a blade of a motor grader as it wears over time is important. The present disclosure includes a calibration procedure wherein the operator moves the blade, and specifically the cutting edge installed on the moldboard, on the ground plane and measures a calibration position using a blade position sensor system installed on the motor grader. Alternatively, the calibration procedure can measure a calibration position without the cutting edge installed on the moldboard wherein the operator moves the blade, i.e., moldboard only, in a calibration position using the blade position sensor system. In either the calibration procedure with cutting edge attached to the moldboard or without the cutting edge attached to the moldboard, the measured calibration position will "zero" out where the ground plane is relative to the motor grader prior to use of the blade. This calibration measurement will be stored in the memory of the motor grader.

The motor grader will be used for a period of time and similar measurements will be taken using the blade position sensor system. Alternatively or additionally, one or more measurements can be taken by one or more of the mainframe position sensor system, blade position sensor system, right and left hydraulic actuators, circle side shift hydraulic actuator, blade pitch actuator, circle drive assembly including a rotation sensor, a blade lift valves assembly, a vision system, grade control system and a hub or known global reference point that measures blade position relative to the ground plane. The control system compares the calibration wear measurement to one or more of these subsequent measurements to determine cutting edge wear, and determines if the cutting edge has worn an unacceptable amount and requires replacement. Additionally, the control system could warn the operator if excessive wear has occurred. Once the blade position measurement reaches a value where additional use of the cutting edge could damage the moldboard, the motor grader or machine would display a pop up, diagnostic trouble code, or another form of operator indication to indicate possible damage to the cutting edge and replacement of the cutting edge is required. Moreover, the system could prevent productive blade movement until the operator replaces the cutting edge and recalibrates the wear measurement system. Productive blade movement includes operating the blade or work implement in a grading operation such that the blade or work implement contacts a ground surface. Therefore limiting productive blade movement will not allow the blade to perform a grading operation however the blade may be operable to perform other non-grading functions that are not considered productive.

Figure 3:
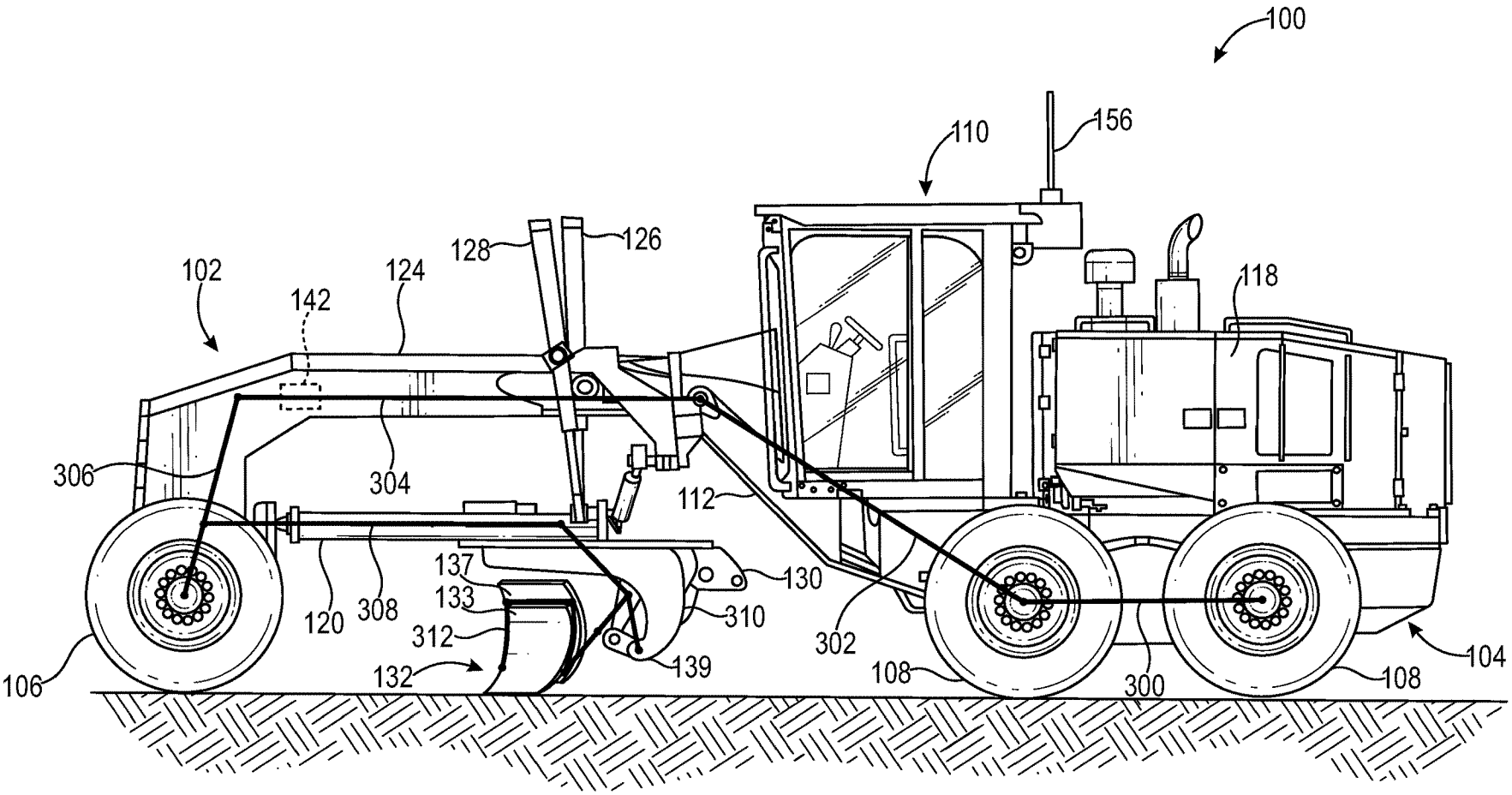
FIG. 3 is a schematic diagram of fixed geometry of certain elements of the motor grade of FIG. 1.
Figure 4:
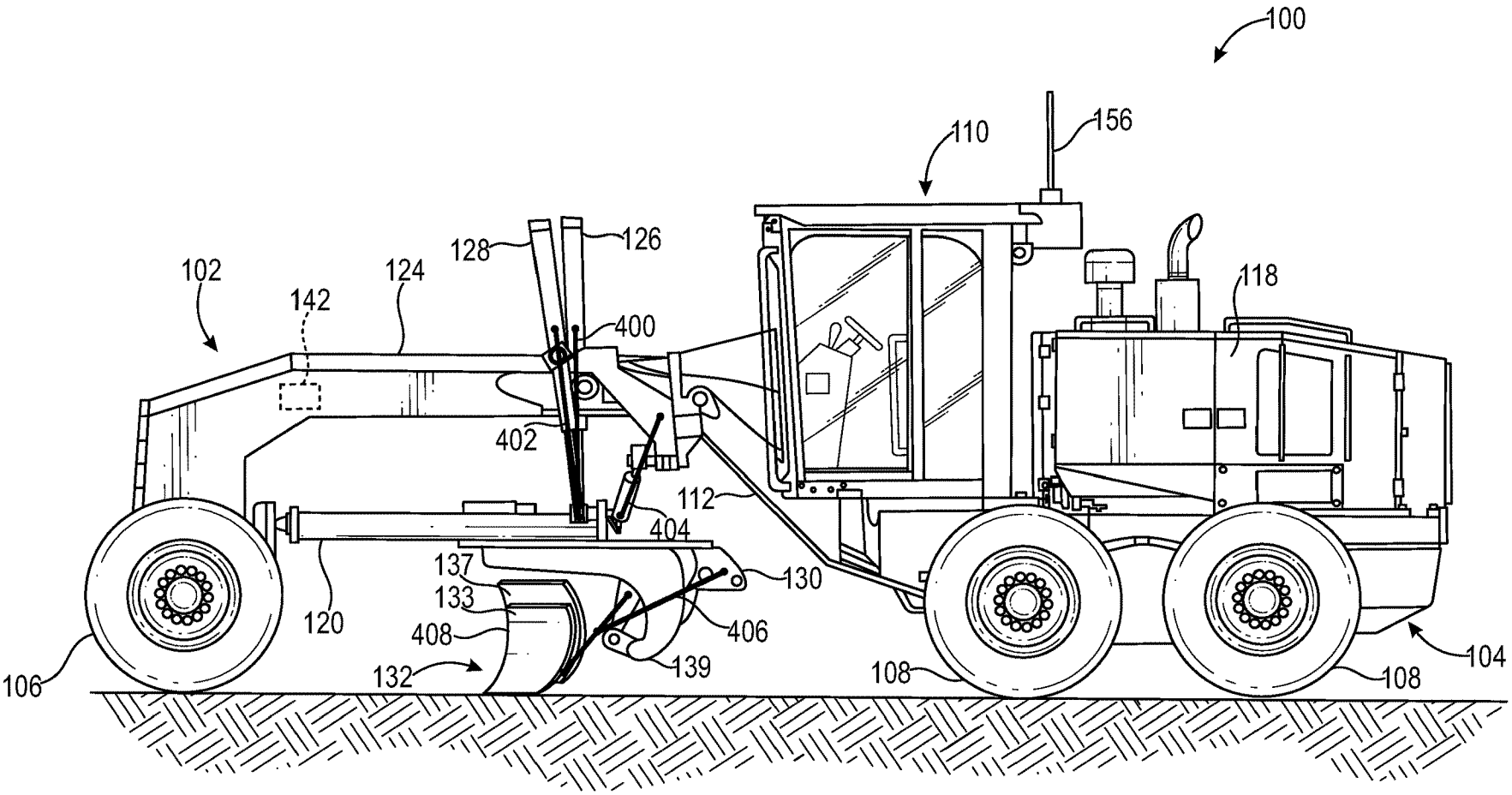
FIG. 4 is a schematic diagram of variable geometry of certain elements of the motor grade of FIG. 1.

Referring to FIGS. 1, 3, and 4, an exemplary embodiment of a machine 100, such as a motor grader, is shown. The machine 100 may be a mobile machine that performs some type of operation associated with an industry such as mining, construction, farming, transportation, or any other industry known in the art. For example, the machine 100 may be a motor grader as depicted in FIG. 1, a tractor or dozer, crawler, excavator, back hoe loader, compact track loader, skid steer loader, four wheel drive loader, a scraper, or any other machine known in the art. While the following detailed description of an exemplary embodiment describes the invention in connection with a motor grader, it should be appreciated that the description applies equally to the use of the invention in other such machines. An example of a motor grader is the 772G Motor Grader manufactured and sold by Deere & Company.

As shown in FIG. 1, the machine 100 includes front frame 102 and rear frame 104, with the front frame 102 being supported on a pair of front wheels 106, and with the rear frame 104 being supported on right and left tandem sets of rear wheels 108. An operator cab 110 is mounted on an upwardly and forwardly inclined rear region 112 of the front frame 102 and contains various controls for the machine 100 disposed so as to be within the reach of a seated operator. In one aspect, these controls may include a steering wheel 114 and a lever assembly 116. The operator cab 110 also includes a display or monitor (not illustrated) for displaying a notification, alert, or message when a cutting edge 133 wears too much according to a service or designated recommendation that indicates the cutting edge 133 should be replaced to avoid damage to a moldboard 137 as described in more detail below.

An engine 118 is mounted on the rear frame 104 and supplies power for all driven components of the machine 100. The engine 118, for example, is configured to drive a transmission (not shown), which is coupled to drive the rear wheels 108 at various selected speeds and either in forward or reverse modes. A hydrostatic front wheel assist transmission (not shown), in different embodiments, is selectively engaged to power the front wheels 106, in a manner known in the art. In one embodiment, the wheels 106 and 108 are pneumatic tires supported by rims as is known by those skilled in the art.

Mounted to a front location of the front frame 102 is a drawbar or draft frame 120, having a forward end universally connected to the front frame 102 by a ball and socket arrangement 122 and having opposite right and left rear regions suspended from an elevated central section 124 of the front frame 102. Right and left lift linkage arrangements including right and left extensible and retractable hydraulic actuators 126 and 128, respectively, support the left and right regions of the draft frame 120. The right and left extensible and retractable hydraulic actuators 126 and 128 either raise or lower the draft frame 120. A side shift linkage arrangement is coupled between the elevated frame section 124 and a rear location of the draft frame 120 and includes an extensible and retractable circle side shift hydraulic actuator 130.

A work implement or blade 132 is coupled to the front frame 102 and powered by a circle drive assembly with a rotation sensor 134. In the illustrated embodiment, the blade 132 includes the cutting edge 133 attached or connected to a moldboard 137. Over time and through use of the blade 132, the cutting edge 133 wears an unacceptable amount or is degraded. If the cutting edge 133 wears or degrades too much or too far, then the moldboard 137 will be exposed and can also be damaged with continued use of the blade 132. For example, illustrated in FIG. 1 is a measurement, W, that indicates a service or designated recommendation of acceptable wear amount for the cutting edge 133. In other embodiments, measurement W may be larger or smaller as designated by the manufacturer to indicate an acceptable amount of wear of the cutting edge 133 before possible damage to the moldboard 137.

The draft frame 120 is raised, lowered, or tilted by the right and left lift linkage arrangements 126 and 128 which in turn raises, lowers, or tilts the blade 132 with respect to the surface. The circle side shift hydraulic actuator 130 shifts the draft frame 120 and the blade 132 right or left. A blade pitch actuator 139 controls the amount of front to back pitch of the blade 132. These adjustments can be made by actuating mechanisms configured to move the blade 132 in response to a control signal provided by an operator or in response to a control signal provided by a machine control system including sonic systems, laser systems, and global positioning systems (GPS).

The circle drive assembly 134 includes a rotation sensor, which in different embodiments, includes one or more sensors that detect movement, speed, or position of the blade 132 with respect to the draft frame 120. In one form, the rotation sensor is electrically coupled to a controller 138. In other forms, the rotation sensor is part of or included with a blade position sensor system 140.

The controller 138 is located in the cab 110 and in other embodiments, the controller 138 is located in the front frame 102, the rear frame 104, or within an engine compartment housing the engine 118. In still other embodiments, the controller 138 is a distributed controller having separate individual controllers distributed at different locations on the vehicle. In addition, while the controller 138 is generally hardwired by electrical wiring or cabling to sensors and other related components, in other embodiments the controller 138 includes a wireless transmitter and/or receiver to communicate with a controlled or sensing component or device which either provides information to the controller or transmits controller information to controlled devices.

Figure 2:
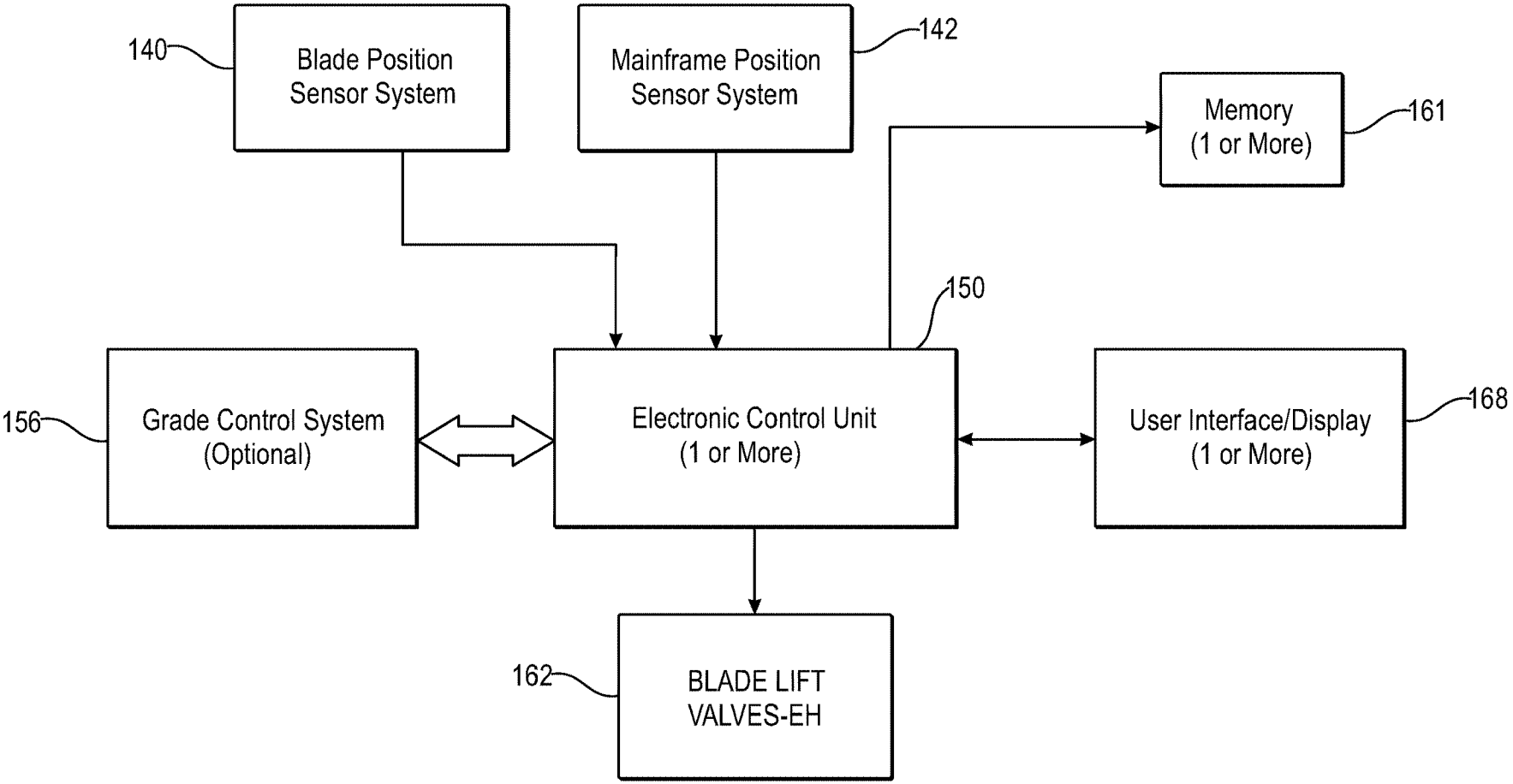
FIG. 2 is a schematic diagram of the motor grade of FIG. 1 and a vehicle grade control system therein.

FIG. 2 is a simplified schematic diagram of a vehicle control system of the machine 100. In this embodiment, the controller 138 is configured as an electronic control unit (ECU) 150 receives sensor data from multiple sources and is operatively connected to these sources. These sources include but are not limited to a blade position sensor system 140, a mainframe position sensor system 142, a blade lift valves assembly 162, and optionally a grade control system 156 that are operatively connected to the ECU 150. The ECU 150 also receives inputs relating to commands from the operator. The ECU 150 is operatively connected to one or more user interfaces 168 and sends information to the user interface 168 and also sends control signals to the actuators.

The ECU 150, in different embodiments, includes a computer, computer system, or other programmable devices. In other embodiments, the ECU 150 can include one or more processors (e.g. microprocessors), and an associated memory 161, which can be internal to the processor or external to the processor. The memory 161 can include random access memory (RAM) devices comprising the memory storage of the ECU 150, as well as any other types of memory, e.g., cache memories, non-volatile or backup memories, programmable memories, or flash memories, and read-only memories. In addition, the memory can include a memory storage physically located elsewhere from the processing devices and can include any cache memory in a processing device, as well as any storage capacity used as a virtual memory, e.g., as stored on a mass storage device or another computer coupled to ECU 150. The mass storage device can include a cache or other dataspace which can include databases. Memory storage, in other embodiments, is located in the "cloud", where the memory is located at a distant location, which provides the stored information wirelessly to the ECU 150.

The ECU 150 executes or otherwise relies upon computer software applications, components, programs, objects, modules, or data structures, etc. Software routines resident in the included memory of the ECU 150 or other memory are executed in response to the signals received. The computer software applications, in other embodiments, are located in the cloud. The executed software includes one or more specific applications, components, programs, objects, modules or sequences of instructions typically referred to as "program code". The program code includes one or more instructions located in memory and other storage devices which execute the instructions which are resident in memory, which are responsive to other instructions generated by the system, or which are provided a user interface operated by the user. The ECU 150 is configured to execute the stored program instructions.

The blade position sensor system 140 detects the slope and pitch of the blade 132 and provides this information to the ECU 150. The mainframe position sensor system 142 detects the grading angle of the machine 100 and provides this information to the ECU 150. The blade lift valves assembly 162 is operatively connected to the right and left lift linkage arrangements 126 and 128 and the circle side shift hydraulic actuator 130. The blade lift valves assembly 162, in one embodiment, is an electrohydraulic (EH) assembly which is configured to raise, lower, or tilt the blade 132 with respect to the surface or ground. In different embodiments, the valve assembly 162 is a distributed assembly having different valves to control different positional features of the blade. For instance, one or more valves adjusts one or both of the linkage arrangements 126 and 128 in response to commands generated by and transmitted to the valves and generated by the ECU 150. Another one or more valves, in different embodiments, adjusts the circle side shift hydraulic actuator 130 in response to commands transmitted to the valves and generated by the ECU 150. The ECU 150 responds to operator input or grade status information provided by the grade control system 156, and adjusts the location of the blade 132 through control of the blade lift valves assembly 162.

The grade control system 156 is generally known in the industry. Some examples of grade control systems 156 include conventional or 2D grade-control systems, sonic sensors or a laser transmitter and sensor along with machine-position sensors to display the cut and fill required to maintain grade on a monitor. Alternatively, the grade control systems 156 can include a 3D grade-control system. The grade control system 156 includes a receiver on the machine 100 that can read the GPS signals received by an elevated antenna as well as correctional data transmitted by a jobsite-based station such as a hub to calculate an accurate cutting-edge position. The ECU 150 compares the cutting-edge position to the design elevations and then displays cut-and-fill information on the user interface or display 168. Other types of grade control systems 156 can be used with this present disclosure.

As discussed in more detail, the present disclosure includes certain elements of the machine 100 considered to have a fixed geometry as illustrated in FIG. 3. These fixed elements 300, 302, 304, 306, 308, 310, and 312, are generally known for any motor grader or machine 100. Certain elements of the machine 100 are considered to have a variable geometry as illustrated in FIG. 4. To measure the variable geometry, the machine 100 is parked on a ground surface plane, with the front tires 106, rear tires 108, and cutting edge 133 on the ground surface plane. It is assumed that the fixed geometry does not change when measuring the variable geometry. However, if the fixed geometry of the machine 100 does change then the present disclosure accounts for this change and can adjust the calibration measurement accordingly. For each instance that the variable geometry is measured, the change in one or more of the variable geometry corresponds to the amount of wear on the cutting edge 133 of the blade 132 has occurred. One or more of the variable elements 400, 402, 404, 406, and 408, are measured by the right hydraulic actuator 126, the left hydraulic actuator 128, the circle side shift hydraulic actuator 130, the blade pitch actuator 139, and circle drive assembly with rotation sensor 134 to determine if the cutting edge 133 has too much wear or an acceptable amount of wear.

Figure 5:
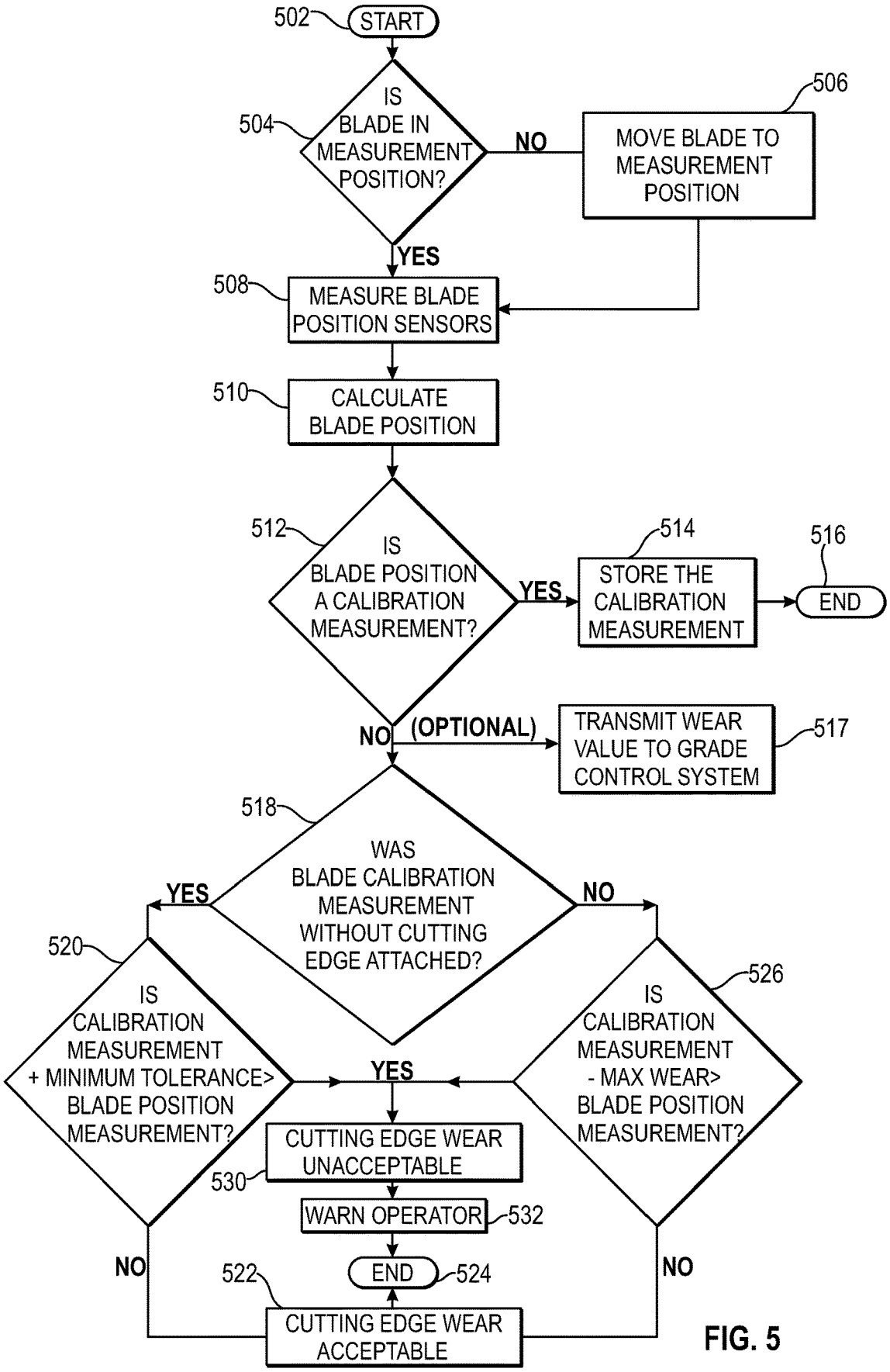
FIG. 5 is a flow diagram of a calibration process of the motor grader of FIG. 1.

FIG. 5 illustrates a flow diagram 500 of a first process of measuring the position of the cutting edge 133 of the blade 132 of the machine 100 or a second process of measuring the position of the moldboard 137 of the blade 132, i.e., measuring the position of the blade 132 without the cutting edge 133 attached to the blade 132. The flow diagram 500 determines whether the measurement is a calibration measurement or a blade position measurement after usage of the blade 132.

Initially, the process begins at start block 502, which in one embodiment, is initiated automatically once the machine 100 is started. In another embodiment, the process is initiated manually once the operator initiates the process by flipping a switch, pressing a button, selecting from a menu, or by activating other user accessible inputs available on a control panel, a display, or a user interface. Once the process has started, the vehicle system, such as the ECU 150, determines the current position of the blade 132 at block 504. While this step is illustrated as occurring immediately after the start block 502, this step, in different embodiments, is implemented at other times during the process. If the current position of the blade 132 is not on the ground surface, then the ECU 150 commands the machine 100 to move the blade 132 to rest on the ground plane in a measurement position at block 506. Alternatively to the ECU 150 commanding the machine 100 to move the blade 132 in an automatic operation, the operator can manually operate the machine 100 to set the blade 132 on the ground plane in the measurement position at block 506. In the measurement position, the machine 100 including the front tires 106 and rear tires 108 are resting on the ground plane or surface and the blade 132 is in a measurement position. While in the measurement position, at block 508 the ECU 150 receives the blade position measurements of the blade 132 from the blade position sensor system 140. At block 510, the ECU 150 calculates the blade position of the blade 132.

At block 512, the ECU 150 determines if the blade position is a calibration measurement or a subsequent measurement. In one form, the calibration measurement of the blade position of the blade 132 is for a new cutting edge 133 that has not been used to grade or cut ground surfaces prior to the measurement. Alternatively in another form, the calibration measurement of the blade position of the blade 132 can be made without the cutting edge 133 being attached to the moldboard 137. The subsequent measurement can occur after the calibration measurement or after the cutting edge 133 has been used to do work. If the blade position is a calibration measurement, then the ECU 150 stores the calibration measurement at block 514 and the process ends at block 516.

If the blade position is not a calibration measurement, i.e., the blade has subsequently been used in a working environment or condition such as for grading, then optionally at block 517 the blade position measurement or blade wear value or measurement can be transmitted to the grade control system 156 for use by the grade control system 156. At block 518, the ECU 150 determines if the blade calibration measurement was made without the cutting edge 133 attached to the moldboard 137. If the blade position measurement was made without the cutting edge 133 attached to the moldboard 137, then at block 520 the ECU 150 determines if the calibration measurement plus a minimum tolerance margin, is greater than the blade position measurement from block 510. The minimum tolerance margin is a value supplied by the manufacturer and varies for the type of machine and the cutting edge 133. If the blade position measurement was made with the cutting edge 133 attached to the moldboard 137, then at block 526 the ECU 150 determines if the calibration measurement less a maximum amount of acceptable wear to the cutting edge 133 is greater than the blade position measurement from block 510. The cutting edge wear condition being acceptable at block 526 can also be determined as an acceptable wear value.

Returning to block 518, if the blade position measurement was made with the cutting edge 133 attached to the moldboard 137, then at block 526 the ECU 150 determines if the calibration measurement less a maximum amount of acceptable wear to the cutting edge 133 is greater than the blade position measurement from block 510. At block 526 if the calibration measurement less a maximum amount of acceptable wear to the cutting edge 133 is not greater than the blade position measurement from block 510, then the cutting edge 133 does not need to be replaced because the cutting edge wear is acceptable at block 522 and the process ends at block 524. Returning to block 526, if the calibration measurement less a maximum amount of acceptable wear to the cutting edge 133 is greater than the blade position measurement from block 510, then the cutting edge 133 is not acceptable and it is possible that the moldboard 137 may be damaged by use of the blade 132 and the cutting edge 133 does need to be replaced because the cutting edge wear condition is unacceptable at block 530. The cutting edge wear condition being unacceptable at block 530 can also be determined as an unacceptable wear value. Optionally a warning signal is given to the operator at block 532 such as an indication on the user interface/display 168 and the process ends at block 524.

Returning to block 518, if the blade position measurement was made without the cutting edge 133 attached to the moldboard 137, then at block 520 the ECU 150 determines if the calibration measurement plus tolerance margin is not greater than the blade position measurement from block 510, then the cutting edge 133 does not need to be replaced because the cutting edge wear is acceptable at block 522 and the process ends at block 524. Returning to block 520, if the calibration measurement plus tolerance margin is greater than the blade position measurement from block 510, then the cutting edge 133 is not acceptable and it is possible that the moldboard 137 may be damaged by use of the blade 132 and the cutting edge 133 does need to be replaced because the cutting edge wear is unacceptable at block 530. Optionally a warning signal is given to the operator at block 532 such as an indication on the user interface/display 168 and the process ends at block 524.

In another embodiment, one or more measurement positions will be taken by one or more of the blade position sensor system 140, the mainframe position sensor system 142, right and left hydraulic actuators or cylinders 126 and 128, the circle side shift hydraulic actuator or cylinder 130, the blade pitch actuator or cylinder 139, the circle drive assembly with rotation sensor 134, the blade lift valves assembly 162, a vision system (not illustrated), and the grade control system 156 and a hub or known global reference point can be used to determine the blade position measurement and/or the calibration measurement and/or blade wear measurement as described in FIG. 5.

In one example of this embodiment, two hydraulic cylinder measurements can be used to determine if the cutting edge 133 has too much wear and should be replaced before damage occurs to the moldboard 137. In this example, the positions of the right hydraulic cylinder 126 and the left hydraulic cylinder 128 are determined to define the blade position measurement and/or the calibration measurement.

The circle side shift position of the circle side shift cylinder 130, the circle rotate position of the circle drive assembly with rotation sensor 134, and the blade pitch position of the blade pitch actuator 139 must be moved into a known calibration position prior to taking the blade position measurement and/or the calibration measurement. The calibration position measurement and the blade position measurement are compared to determine the wear of the cutting edge 133 and whether it needs to be replaced as described with respect to FIG. 5. In a second example of this embodiment, three hydraulic cylinder measurements can be used to determine if the cutting edge 133 has too much wear and should be replaced before damage occurs to the moldboard 137. In this example, the positions of the right hydraulic cylinder 126, the left hydraulic cylinder 128, and the circle side shift cylinder 130 are determined to define the blade position measurement and/or the calibration measurement. The circle rotate position of the circle drive assembly with rotation sensor 134 and the blade pitch position of the blade pitch actuator 139 must be moved into a known calibration position prior to taking the blade position measurement and/or the calibration measurement. The calibration position measurement and the blade position measurement are compared to determine the wear of the cutting edge 133 and whether it needs to be replaced as described with respect to FIG. 5.

In a third example of this embodiment, three hydraulic cylinder measurements and a rotation sensor measurement can be used to determine if the cutting edge 133 has too much wear and should be replaced before damage occurs to the moldboard 137. In this example, the positions of each of the right hydraulic cylinder 126, the left hydraulic cylinder 128, the circle side shift cylinder 130, and the circle rotate position of the circle drive assembly with rotation sensor 134 are determined to define the blade position measurement and/or the calibration measurement. The blade pitch position of the blade pitch actuator 139 must be moved into a known calibration position prior to taking the blade position measurement and/or the calibration measurement. The calibration position measurement and the blade position measurement are compared to determine the wear of the cutting edge 133 and whether it needs to be replaced as described with respect to FIG. 5.

In a fourth example of this embodiment, four hydraulic cylinder measurements can be used to determine if the cutting edge 133 has too much wear and should be replaced before damage occurs to the moldboard 137. In this example, the positions of the right hydraulic cylinder 126, the left hydraulic cylinder 128, the circle side shift cylinder 130, and the blade tilt cylinder 162 are used to determine the blade position measurement and/or the calibration measurement. The circle rotate position of the circle drive assembly with rotation sensor 134 must be moved into a known calibration position prior to taking the blade position measurement and/or the calibration measurement. The calibration position measurement and the blade position measurement are compared to determine the wear of the cutting edge 133 and whether it needs to be replaced as described with respect to FIG. 5.

In a fifth example of this embodiment, four hydraulic cylinder measurements and a rotation sensor measurement can be used to determine if the cutting edge 133 has too much wear and should be replaced before damage occurs to the moldboard 137. In this example, the positions of the right hydraulic cylinder 126, the left hydraulic cylinder 128, the circle side shift cylinder 130, the blade tilt cylinder 162, and the circle drive assembly with rotation sensor 134 are used to determine the blade position measurement and/or the calibration measurement. The calibration position measurement and the blade position measurement are compared to determine the wear of the cutting edge 133 and whether it needs to be replaced as described with respect to FIG. 5.

In a sixth example of this embodiment, a fixed camera is operably connected to the machine 100 wherein the fixed camera determines the coordinates of the blade position measurement and/or the calibration measurement. The calibration position measurement and the blade position measurement are compared to determine the wear of the cutting edge 133 and whether it needs to be replaced as described with respect to FIG. 5.

In a seventh example of this embodiment, a grade control system 156 and a known point or hub can be used to determine if the cutting edge 133 has too much wear and should be replaced before damage occurs to the moldboard 137. The known point or hub is a measured point that is known geographically and measured on a global reference. In this example, to determine the calibration measurement and the blade position measurement, the blade 132 is positioned on the known point or hub and the geographic/globally referenced blade position measurement is taken by the grade control system. The known location of the hub and the blade position measurement are compared to determine the wear of the cutting edge 133 and whether it needs to be replaced as described with respect to FIG. 5.

In an eighth example of this embodiment, the grade control system 156 measures the calibration measurement and/or the blade position measurement relative to the machine 100. The calibration position measurement and the blade position measurement are compared to determine the wear of the cutting edge 133 and whether it needs to be replaced as described with respect to FIG. 5.

One or more of these embodiments can be combined to determine whether the cutting edge 133 requires replacement or is acceptable. As described above, the ECU 150 could warn the operator if excessive wear has occurred. Once the cutting edge measurement reaches a value where additional use of the cutting edge 133 could damage the moldboard 137, the motor grader or work vehicle can display a pop up, diagnostic trouble code, or another form of operator indication to indicate possible damage to the moldboard and replacement of the cutting edge 133 is required. Moreover, the system could prevent the productive blade movement of the blade 132 until the operator replaces the cutting edge 133 and/or recalibrates the wear measurement system. As discussed above, the productive blade movement of the blade 132 includes operating the blade 132 in a grading operation. Therefore limiting productive blade movement will not allow the blade 132 to perform a grading operation on the ground however the blade 132 may be operable to perform other non-grading functions that are not considered productive. Alternatively, the machine 100 may have limited productive movement, such as derating the machine 100, limiting the power and speed of the engine 118, which in turn limits productive movement of the blade 132.

While exemplary embodiments incorporating the principles of the present disclosure have been described hereinabove, the present disclosure is not limited to the described embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A method for measuring wear of a cutting edge of a blade of a work vehicle, the method comprising:

providing the work machine with a circle side shift cylinder, a controller, and a blade position sensor system;

measuring a calibration position measurement of the blade with the cutting edge attached thereto and the circle side shift cylinder, while the blade and the circle side shift cylinder are in a measurement position;

at a later point in time after the measuring the calibration position measurement is performed, moving the blade and the circle side shift cylinder to the measurement position that corresponds to the calibration position measurement of the blade;

after the moving of the blade and the circle side shift cylinder to the measurement position, measuring a blade position measurement of the blade and the circle side shift cylinder in the measurement position;

upon comparison of the blade position measurement to the calibration position measurement, determining a wear condition of the cutting edge of the blade as either acceptable wherein the cutting edge does not require replacement or unacceptable wherein the cutting edge does require replacement; and automatically limiting productive movement of the blade wherein the blade is only operable to perform a non-grading operation when the unacceptable wear condition is satisfied.

2. The method of claim 1, wherein the determining the wear condition of the cutting edge includes calculating an amount the cutting edge has worn.

3. The method of claim 1, wherein the determining the acceptable wear condition of the cutting edge of the blade when the blade position measurement less an acceptable wear to the cutting edge amount is less than the blade calibration position measurement.

4. The method of claim 1, further comprising sending a warning signal to the work vehicle when the unacceptable wear condition is satisfied.

5. The method of claim 4, wherein the warning signal is a message displayed on a display mechanism of the work vehicle.

6. The method of claim 1, wherein the productive movement of the blade is not enabled when the unacceptable wear condition is satisfied.

7. The method of claim 1, wherein the blade position measurement includes resting the blade on a ground plane.

8. The method of claim 1, further comprising:

communicating the blade wear measurement to a grade control system to adjust one or more of a slope, an angle, or an elevation of the blade.

9. The method of claim 1, wherein the limiting productive movement of the blade includes preventing the blade from performing a grading operation wherein the blade contacts a work surface.

10. A method for measuring wear of a cutting edge of a blade of a work vehicle, the method comprising:

providing the work machine with a blade pitch actuator, a controller, and a blade position sensor system;

measuring a calibration position measurement of the blade, without the cutting edge present, and the blade pitch actuator, while the blade and the blade pitch actuator are in a measurement position;

at a later point in time after the measuring the calibration position measurement is performed, measuring a blade position measurement of the blade, with the cutting edge attached to the blade, and the blade pitch actuator while the blade and the blade pitch actuator are in the measurement position; and upon comparison of the blade position measurement to the calibration position measurement, determining a wear condition of the cutting edge of the blade as either acceptable wherein the cutting edge does not require replacement or unacceptable wherein the cutting edge does require replacement and automatically operating the blade in a non-grading operation.

11. The method of claim 10, wherein the determining the unacceptable wear condition of the cutting edge of the blade includes the blade calibration position measurement plus a tolerance margin being greater than the blade position measurement.

12. The method of claim 10, wherein the determining the acceptable wear condition of the cutting edge of the blade includes the blade calibration position measurement plus a tolerance margin being less than the blade position measurement.

13. The method of claim 10, further comprising:

sending a warning signal to the work vehicle when the unacceptable wear condition is satisfied; and displaying the warning signal on a display mechanism of the work vehicle.

14. The method of claim 10, further comprising limiting productive movement of the blade wherein the blade is only operable to perform a non-grading operation when the unacceptable wear condition is satisfied.

15. The method of claim 14, wherein the productive movement of the blade is not enabled when the unacceptable wear condition is satisfied.

16. The method of claim 10, wherein the blade position measurement includes resting the blade on a ground plane.

17. The method of claim 10, further comprising:

determining a wear value from the wear condition; and communicating the wear value to a grade control system to adjust one or more of a slope, an angle, or an elevation of the blade.

18. The method of claim 10, wherein the determining the wear condition of the cutting edge includes calculating an amount the cutting edge has worn.

19. The method of claim 10, wherein the determining the unacceptable wear condition of the cutting edge of the blade includes the blade position measurement less an acceptable wear amount to the cutting edge being greater than the calibration position measurement.

* * * * *